United States Patent [19]

Jensen

[11] 4,169,551

[45] Oct. 2, 1979

[54] APPARATUS FOR THREADING MOVING STRANDS

[75] Inventor: Thomas H. Jensen, Murrysville, Pa.

[73] Assignee: PPG Industries, Inc., Pittsburgh, Pa.

[21] Appl. No.: 882,027

[22] Filed: Feb. 28, 1978

[51] Int. Cl.[2] ..... G03B 1/56

[52] U.S. Cl. ..... 226/92; 57/1 R

[58] Field of Search ..... 57/1 R, 22, 23, 34 R, 57/159, 261; 226/91-92

[56] References Cited

U.S. PATENT DOCUMENTS

| | | | |
|---|---|---|---|
| 3,732,678 | 5/1973 | Beery, Jr. | 57/22 |
| 3,810,568 | 5/1974 | Kwiaikowski et al. | 226/92 |
| 4,002,013 | 1/1977 | Johnson et al. | 57/22 |
| 4,065,042 | 12/1977 | Zielinski | 226/92 |

*Primary Examiner*—Charles Gorenstein

*Attorney, Agent, or Firm*—John E. Curley; Alan T. McDonald

[57] ABSTRACT

An apparatus is disclosed for threading one of several generally parallel strands through an operation through which the strands travel. The apparatus is designed to thread a broken strand using the movement of strands adjacent to this strand. The apparatus is also designed to reduce the downtime for the adjacent strands which are employed to pull and guide the broken strand through the rethreading operation. The apparatus is designed to allow for strand guide stabilization through the rethreading operation to allow the strands and guide to pass through the system easily and without placement errors in strand threading positioning. The apparatus includes a means for holding the broken strand, a means for releasably maintaining an adjacent guide strand within the apparatus and a means for releasably grasping the moving pull strand. The apparatus is designed to be threaded while the pull strand and guide strand remain in motion and to allow the guide strand to be removed from the apparatus without stopping this moving strand. This substantially reduces the downtime of adjacent strands in rethreading a broken strand.

5 Claims, 7 Drawing Figures

APPARATUS FOR THREADING MOVING STRANDS

BACKGROUND OF THE INVENTION

In numerous strand treating operations, it is common to treat a plurality of parallel strands through a continuously moving operation. Typical of such operations is in the drying of coated strands. Examples of the drying of parallel coated strands, such as glass strands, can be found in U.S. Pat. Nos. 3,619,252 and 3,914,477.

Clearly, it is desired that these operations run continuously. However, due to any of numerous reasons, strand breakouts do occur.

In the past, when a strand breakout has occurred, it was necessary to stop the movement of the strandson either side of the broken strand and to tie the broken strand to each of the adjacent strands. The adjacent strands were then restarted, which pulled the broken strand back through the operation and rethreaded it. Finally, the adjacent strands were again stopped to untie the now threaded strand from them and restart the three strands.

During the stopping and starting of the adjacent strands, and due to the continuous nature of the drying operation, the strands stopped within the operation were overcured and thus wasted. Thus, during the entire rethreading operation, production was lost from all three affected strands. Added to this cost is the cost of splicing the partial packages of strand formed when breakouts, whether accidental, as in the strand to be repaired, or intentional, as in the rethreading strands, occur, to form acceptable size packages.

To make matters worse, in the formation of glass fiber tire cord and other elastomeric reinforcements, often three strands are twisted into a single cord after passing through the drying operation. If the broken strand is either of the two outer strands of the group of three parallel strands passing through the oven to form a single cord, as will be the case in two out of every three occurrences on the average, employing the two adjacent strands to tie the broken strand and rethread it requires not only to stop the three strands of the cord containing the broken strand but also the three strands of the adjacent cord for which one of the strands must be employed as a rethreading strand. Thus, in two out of every three strand breakouts, on the average, to repair the single broken strand the production from six strands is affected.

This stopping, tieing, restarting, stopping and final restarting operation is also time consuming. Thus, it is often found that up to 20 minutes of lost production from up to six adjacent strands may be affected from the breakout of a single strand.

It is, therefore, desirable to produce an apparatus for rethreading a broken strand in a continuous, generally parallel strand treating operation which reduces the number of strands affected by the breakout and which limits the affected strands to strands of a single cord. It is also desirable to produce an apparatus which is simple in operation and which will reduce the amount of time necessary to complete the rethreading operation.

THE PRESENT INVENTION

By means of the present invention, an apparatus is produced which when employed to restart a broken strand will accomplish the above-identified desired results.

The apparatus of the present invention comprises a clip having a means for connecting the broken strand thereto, a releasable means for maintaining a guide strand within said clip, which guide strand may freely pass through the clip and need not be stopped during the entire rethreading operation, and a means for grasping a moving pull strand, said moving pull strand providing the forces necessary to rethread the broken strand. The clip is constructed and arranged to allow the strands to move about rollers, pulleys or other guides through which they are threaded. By employing the clip of the instant invention, a strand can be rethreaded "on the fly", that is, without stopping the guide strand at any point during the rethreading operation and without stopping the pull strand to start the threading operation. The pull strand is stopped only at the end of the rethreading operation. This substantially reduces the number and length of interruptions for adjacent strands to rethread the broken strand. The clip also enables complete rethreading to be accomplished with the stopping only of strands within a single cord, thus again substantially reducing lost production by eliminating downtime of adjacent cords during the rethreading operation in a multiple strand to single cord twisting operation.

BRIEF DESCRIPTION OF THE DRAWINGS

The strand threading apparatus of the present invention will be more fully described with respect to the drawings in which.

DETAILED DESCRIPTION OF THE DRAWINGS

Figure 1:
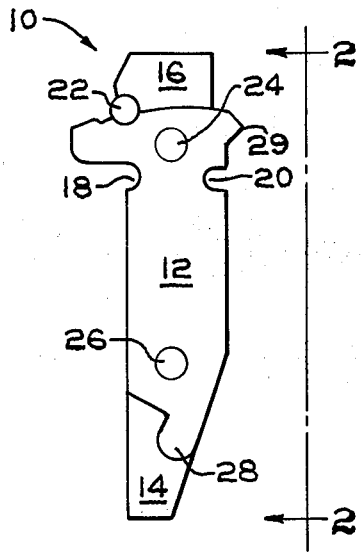
FIG. 1 is a front elevational view of the broken strand retaining member of the clip of the present invention.
Figure 2:
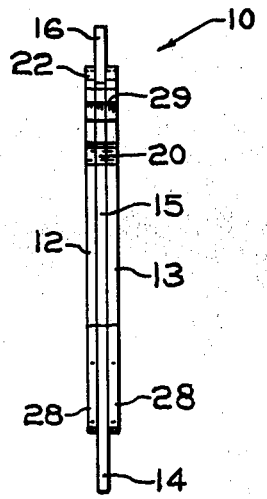
FIG. 2 is a right side elevational view taken through line 2—2 of FIG. 1.
Figure 3:
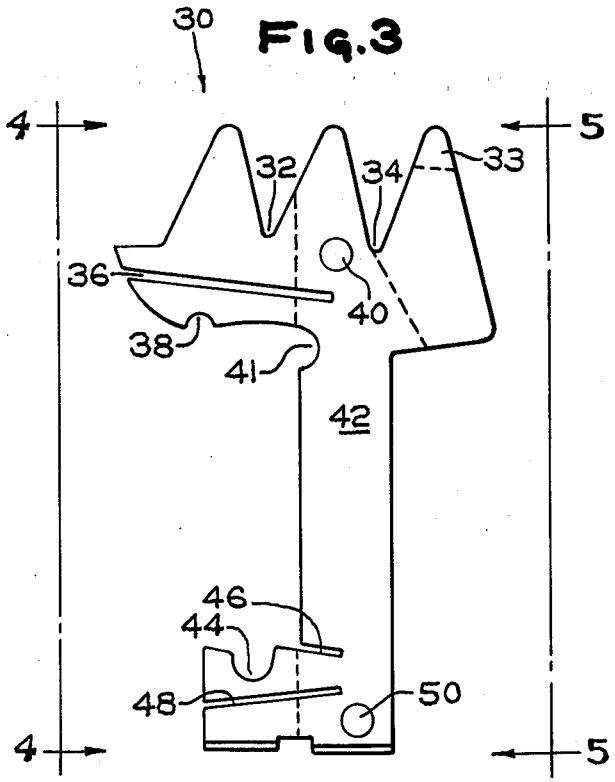
FIG. 3 is a front elevational view of the guide member of the clip of the present invention.
Figure 4:
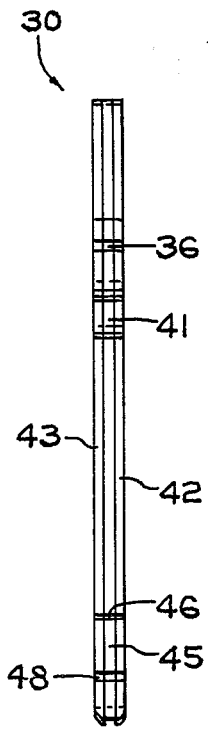
FIG. 4 is a left side elevational view of the guide member taken through line 4—4 of FIG. 3.
Figure 5:
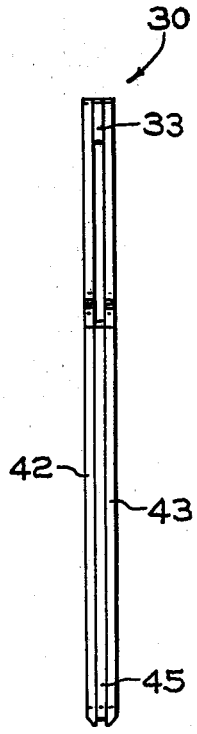
FIG. 5 is a right side elevational view of the guide member taken through line 5—5 of FIG. 3.

Turning to the Figures, the clip of the present invention is formed of two basic parts, a broken strand retaining and carrying member 10, illustrated in FIGS. 1 and 2, and a guide member 30, illustrated in FIGS. 3 through 5.

The broken strand retaining member 10 is illustrated as being formed of a three-layered laminant. Clearly, this member 10 could be formed of a single molded piece, if desired. The member 10 includes a head 16 and a tail 14 of a single thickness formed as extensions from core 15. The head 16 and tail 14 fit within the guide member 30, as will be discussed below. Faces 12 and 13 are attached on either side of core 15 containing head 16 and tail 14 by means such as pins 24 and 26. Clearly, other attaching means, such as cement and the like may be employed and, if the member 10 is formed of a single piece, no attaching means are necessary. The broken strand retaining member 10 includes slots or indentations 18 and 20 around which the broken strand is wrapped and held. A pivot shape 28 is employed, as will be discussed below, to pivotally locate the broken strand retaining member 10 within the guide member 30. Restraining pin 22 is located on member 10 to retain it within guide member 30, as will be discussed below. Finally, protrusion 29 is provided and fitted within guide 30 to lock the clip onto the pull strand during operation of the clip, as will be discussed below.

Guide member 30 includes three layers, or lamina, as does broken strand retaining member 10. Again, this element could be molded of a single piece, but is shown as being constructed of three layers, 42, 43 and 45, with these layers being laminated by means of pins 40 and 50 or by cement or other appropriate means.

Guide member 30 includes a pair of grooves 32 and 34 within which the guide strand and pull strand ride. These grooves 32 and 34 are sized and positioned to allow the guide and pull strands to run in their normal generally parallel fashion through the operation being performed. Thus, their exact size and shape will vary for different operations. Grooves 38 and 44 are provided in guide member 30 to firmly fit retaining member 10 within guide member 30. Tail 14 fits between faces 42 and 43 and pivot 28 fits within groove 44. As retaining member 10 is rotated into position around pivot 28 and within guide 30, restraining pin 22 is forced into groove 38 and protrusion 29 fits within groove 41. Grooves 36, 46 and 48 are provided and act as springs to allow grooves 38 and 44 to elastically expand during the rotation of retaining member 10 into position producing the necessary quick "snap action" to pinch the pull strand and release the clip from the operator and to allow for removal of retaining member 10 from guide member 30 and to allow firm holding of retaining member 10 within guide 30 during operation of the clip.

Guide member 30 also includes restraining guide 33. This member 33 is attached to either wall 42 or 43, but not both. This member is tapered to allow the guide strand to slip between walls 42 and 43 and within groove 34. The guide member 33 is employed to maintain the guide strand within groove 34 while traveling through the process but to allow the strand to be removed from groove 34 with sufficient traverse "pull" from the strand treating operation at the appropriate point in the process, if desired.

Figure 6:
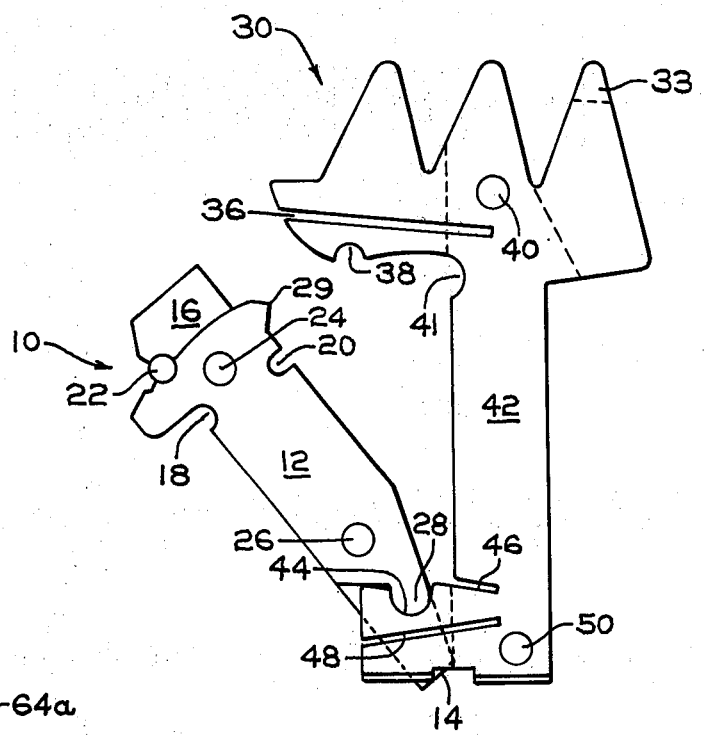
FIG. 6 is a front elevational view of the clip of the present invention in its open state.
Figure 7:
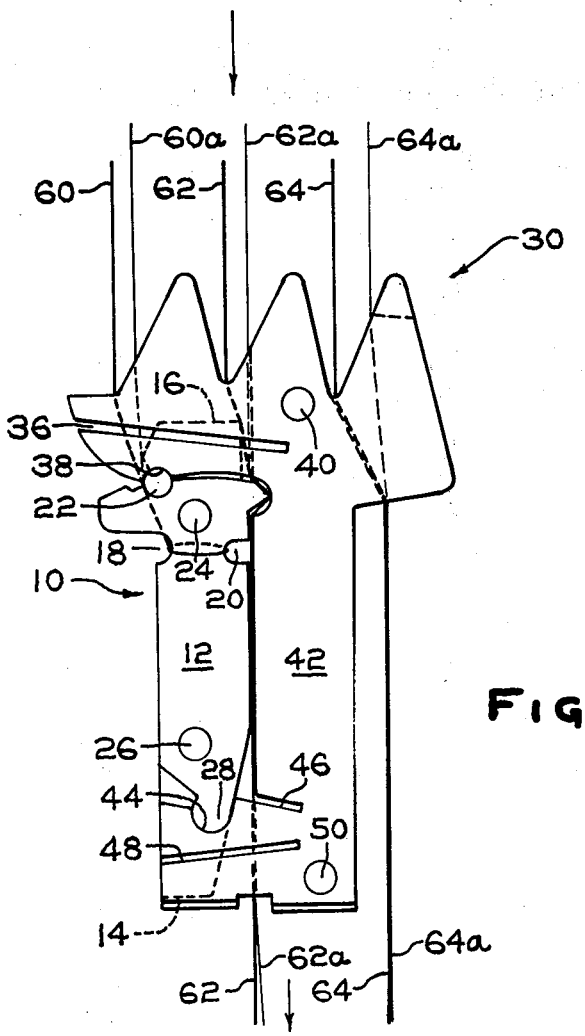
FIG. 7 is a front elevational view of the clip of the present invention in its closed state, illustrating the outer limit locations of the various strands within the clip.

The operation of the clip is best seen in FIGS. 6 and 7. The parallel strands 60, 62 and 64 are positioned in the guide separately. Strand 60 represents the broken strand which is to be rethreaded through the system. This strand 60 is wrapped around broken strand retaining member 10 in its grooves 18 and 20. Strand 64, which is the guide strand, is positioned within the clip by guiding it between wall 42 or 43 and restraining member 33, with the guide strand 64 then free to move within groove 34. Pulling strand 62 is then guided between walls 42 and 43 and into position next to core 45. This is accomplished by threading strand 62 through guide member 30 prior to positioning broken strand retaining member 10 therein. After strands 64 and 62 are in place, broken strand retaining member 10 is inserted into guide member 30 as illustrated in FIG. 6. At this point, strands 62 and 64 are still free to move through the clip, as the clip is held in the operator's hands.

To begin the rethreading operation, the operator rotates broken strand retaining member 10 into the position shown in FIG. 7. Thus, head 16 passes between walls 42 and 43 and is held in position by pin 22 and groove 38.

When broken strand retaining member 10 is rotated and snapped into the locked position shown in FIG. 7, pull strand 62 is locked between core 45 of guide member 30 and core 15 of broken strand retaining member 10 and between protrusion 29 of reinforcing member 10 and groove 41 of guide 30. This immediately starts the guide member in movement through the sytem and threads broken strand 60 through the system.

The strand positions 60, 62 and 64 are one extreme position which the various strands may take and remain in their generally parallel alignments. Positions **60*a*, 62*a* and 64*a*** represent the other generally parallel extreme positioning for the strands. Thus, at the points of travel of the strands through the system, the strands may take any position between these extremes. This gives flexibility in allowing the strands to pass over guides, pulleys and the like and enables threading of the system with the generally flat and inflexible guide member clip by allowing the clip to slightly rotate and self-adjust to these elements as necessary as it passes over them without misthreading of the strand.

When the system has been threaded, strand 62 is stopped in its movement. Strand 64 may, however, continue to pass through the clip, since it is not held in fixed position during travel of the strands through the system, as is strand 62. This strand will be stopped, however, if strands 60, 62 and 64 make up one single cord of themselves. Thus, depending upon the alignment of the strands in the system being threaded, strand 64 may be removed from the clip through restraining clip 33 either by the operator, or by the action of the strand treating system itself, as previously mentioned, when strand 64 is no longer needed for guide purposes.

As previously mentioned, strand 62 is the only strand which must be stopped in its movement to complete the rethreading operation. Thus, after strand 60 has been rethreaded, strand 62 is stopped and strands 60 and 62 are removed from the clip, wound back into operation, and the clip is cleared of excess strand. The clip is then ready for reuse during the next strand breakout. Thus, using the clip of the present invention, significant reductions in the time necessary to rethread a broken strand are realized and downtime losses from the number of strands necessary to rethread the broken strand are substantially reduced. Clearly, should the strand being broken be in the position illustrated at 64 rather than 60, the clip may be rotated 180° about its vertical axis so that strand 62 may again be used as the pulling strand. This result is necessary when the broken strand is the outside of a group of three strands which is being formed into a single cord. Thus, as previously mentioned, a strand breakout from any position can be repaired without resort to employment of any strands from a cord other than the cord from which the strand has broken.

The clip is formed of a material which will withstand the environment of the operation through which it will pass. A typically satisfactory material is a glass reinforced resin, including high impact strength plastics as epoxies or the like.

While the invention has been described with reference to a certain specific embodiment thereof, it is not intended to be so limited thereby, except as set forth in the accompanying claims.

I claim:

1. A rethreading clip constructed and arranged to rethread a broken strand or thread passing into a process wherein a multiplicity of strands pass in parallel through said process comprising a guide member slotted on its lateral walls to permit strand to pass freely through said slots, retaining means constructed to grip one end of a broken thread to be attached thereto, means in said guide member to insert said retaining means so that when inserted in said guide member said retaining means contacts a moving strand in one of said slots to firmly clamp at least one thread passing through one of said slots to the body of said guide member.

2. The apparatus of claim 1 including means to lock said retaining means onto said guide member when it is inserted in said guide member.

3. The apparatus of claim 1 wherein said guide member is provided on one end thereof with a plurality of grooves for guiding strand moving in said slots and the strand held by the retaining means to maintain them parallel and separate while the rethreading clip is in use.

4. The apparatus of claim 1 wherein said guide member is provided with an elongated lateral slot below the point at which the retaining means is inserted into said guide member to provide spring action against the retaining means when it is placed in an operative position to assist in locking it into place.

5. A rethreading clip for use in rethreading a broken thread in an operation involving the utilization of a multiplicity of parallel running threads comprising a generally flat guide member provided with a top and a bottom portion said bottom portion being characterized by having on the bottom surface thereof a plurality of toothlike grooves, two elongated lateral slots being provided in the sidewalls of said guide member constructed and arranged to permit moving thread to pass therethrough freely when the guide member is held in position in the process to permit threads to flow therethrough, a pivotally insertable retaining member associated with said guide member and provided with means at the bottom portion thereof to attach a broken thread thereto, said retaining member being constructed and arranged to pivot on a pivot point positioned on said guide member and being provided with means on the bottom surface thereof for locking said retaining means in place when it is inserted in said guide member, means on a lateral wall of said retaining means constructed and arranged to grip firmly a moving strand passing in the slot of said guide member once the retaining means is inserted in said guide means and locked in place.

* * * * *